US012022891B2

(12) United States Patent
Kallile et al.

(10) Patent No.: US 12,022,891 B2
(45) Date of Patent: Jul. 2, 2024

(54) NURSING BRASSIERE

(71) Applicant: Lunnie LLC, Dayton, OH (US)

(72) Inventors: Sarah Kallile, Dayton, OH (US); Susanne Beresh, Dayton, OH (US)

( * ) Notice: Subject to any disclaimer, the term of this patent is extended or adjusted under 35 U.S.C. 154(b) by 108 days.

(21) Appl. No.: 17/840,127

(22) Filed: Jun. 14, 2022

(65) Prior Publication Data

US 2023/0397673 A1 Dec. 14, 2023

(51) Int. Cl.
*A41C 3/04* (2006.01)
*A41C 3/12* (2006.01)

(52) U.S. Cl.
CPC . *A41C 3/04* (2013.01); *A41C 3/12* (2013.01)

(58) Field of Classification Search
CPC ..... A41C 3/04; A41C 3/12; A41C 3/142
USPC ..... 450/36
See application file for complete search history.

(56) References Cited

U.S. PATENT DOCUMENTS

| | | | | |
|---|---|---|---|---|
| 6,346,027 | B1 * | 2/2002 | Merkovsky | A41C 3/04 450/38 |
| 10,786,016 | B2 | 9/2020 | Caden | |
| 2005/0208873 | A1 * | 9/2005 | Rothman | A41C 3/08 450/36 |
| 2016/0165962 | A1 * | 6/2016 | Hayes | A41C 3/0064 450/55 |
| 2016/0183602 | A1 * | 6/2016 | Rider | A61M 1/06 450/36 |
| 2018/0064178 | A1 * | 3/2018 | Akerson | A41C 3/02 |

* cited by examiner

*Primary Examiner* — Timothy K Trieu
(74) *Attorney, Agent, or Firm* — Thomas E. Lees, LLC

(57) ABSTRACT

A nursing brassiere has an under bust band that wraps around a torso of a wearer thus defining a front side and a back side relative to the torso. The brassiere also includes a side sling having a bottom portion that couples to the under bust band along at least a portion of the front side thereof. A strap couples to a top portion of the side sling, and further couples to the under bust band along the back side thereof. Further, the brassiere includes a cup having an inside cup layer, an absorbent layer, a pad, and an outside cup layer. The absorbent layer and the pad are stitched in between the inside cup layer and the outside cup layer so as to be non-removable. The cup attaches to the under bust band and is user connectable and dis-connectable from the strap about a top portion thereof.

20 Claims, 7 Drawing Sheets

NURSING BRASSIERE

BACKGROUND

Various aspects of the present invention relate generally to brassiere, in particular, to a brassiere that is suitable for wearing while lactating, and more particularly, to a nursing brassiere that is suitable for wearing while breast feeding.

Undergarments are items of clothing that are worn beneath outerwear clothing. Undergarments may shape to the body and provide a support and comfort layer between skin and the outerwear. A brassiere is an example of an undergarment that is typically worn to cover and provide support to breasts of the wearer.

BRIEF SUMMARY

According to aspects of the present disclosure, a nursing brassiere is provided. The nursing brassiere comprises an under bust band, a side sling, a strap, and a cup. The under bust band has a generally elongate shape that wraps around a torso of a wearer thus defining a front side and a back side relative to the torso. The side sling has a bottom portion and a top portion generally opposite the bottom portion. The bottom portion of the side sling couples to the under bust band along at least a portion of the front side thereof. The strap couples to the top portion of the side sling, and further couples to the under bust band along the back side thereof. The cup has an inside cup layer, an absorbent layer, a pad, and an outside cup layer. In this configuration, the absorbent layer and the pad are stitched in between the inside cup layer and the outside cup layer so as to be non-removable. Moreover, the cup defines a bottom portion and a top portion generally opposite the bottom portion. The bottom portion of the cup is coupled to the under bust band along at least a portion of the front side thereof. Additionally, the top portion of the cup is user connectable and dis-connectable from at least one of the strap or the side sling.

According to further aspects of the present disclosure, a nursing brassiere has an under bust band, a first cup, a second cup, a first strap, and a second strap. The first strap functions as a first shoulder strap. Correspondingly, the second strap functions as a second shoulder strap. The under bust band has a generally elongate shape that wraps around a torso of a wearer thus defining a front side and a back side relative to the torso. The first cup and the second cup are positioned adjacent to one another. Moreover, each of the first cup and the second cup have a bottom portion that couples to and extends upward from the under bust band, e.g., from the front side of the under bust band. Also, each of the first cup and the second cup further comprise an inside cup layer, an absorbent layer, a pad, and an outside cup layer. Under this configuration, the absorbent layer and the pad are stitched in between the inside cup layer and the outside cup layer so as to be non-removable.

The first shoulder strap and the second shoulder strap are each coupled to the under bust band (e.g., coupled between the front side and the back side of the under bust band). In this regard, in some embodiments, the each shoulder strap may couple via various intermediate layers. For instance, the first shoulder strap may couple to the front side of the under bust band via a first side sling, the second shoulder strap may couple to the front side of the under bust band via a second side sling, the first shoulder strap may couple to the back side of the under bust band via a first side band, the second shoulder strap may couple to the back side of the under bust band via a second side band, combinations thereof, etc. Also, the first cup is user connectable and user dis-connectable from the first shoulder strap. Likewise, the second cup is user connectable and user dis-connectable from the second shoulder strap.

According to yet further aspects of the present disclosure, a nursing brassiere has an under bust band having a generally elongate shape that wraps around a torso of a wearer thus defining a front side and a back side relative to the torso. The nursing brassiere also includes a left side sling and a right side sling. The left side sling has a bottom portion and a top portion generally opposite the bottom portion, where the bottom portion couples to the under bust band along at least a portion of the front side thereof. Similarly, the right side sling has a bottom portion and a top portion generally opposite the bottom portion, where the bottom portion couples to the under bust band along at least a portion of the front side thereof.

The nursing brassiere further includes a left side strap that couples to the top portion of the left side sling, where the left side strap further couples to the under bust band along the back side thereof. Similarly, a right side strap couples to the top portion of the right side sling, and the right side strap further couples to the under bust band along the back side thereof.

The nursing brassiere still further includes a left side cup having an inside cup layer, an absorbent layer, a pad, and an outside cup layer, where the left side cup further defines a bottom portion and a top portion generally opposite the bottom portion. Here, the absorbent layer and the pad are stitched in between the inside cup layer and the outside cup layer so as to be non-removable. Also, the bottom portion of the left side cup is coupled to the under bust band along at least a portion of the (left) front side thereof, and the top portion of the left side cup is user connectable and dis-connectable from at least one of the left side strap or the left side sling.

Likewise, a right side cup has an inside cup layer, an absorbent layer, a pad, and an outside cup layer, where the right side cup further defines a bottom portion and a top portion generally opposite the bottom portion. The absorbent layer and the pad are stitched in between the inside cup layer and the outside cup layer so as to be non-removable. Also, the bottom portion of the right side cup is coupled to the under bust band along at least a portion of the (right) front side thereof, and the top portion of the right side cup is user connectable and dis-connectable from at least one of the right side strap or the right side sling.

The nursing brassiere additionally includes a left side band that is coupled to and extends from the front side of the under bust band to the back side of the under bust band (e.g., defining a left side thereof), where the left side band couples to at least one of the left side sling or the left cup along an edge thereof. Here, the left side strap couples to the back side of the under bust band via the left side band such that the left side strap connects to the left side band and the left side band connects to the back side of the under bust band. Likewise, a right side band is coupled to and extends from the front side of the under bust band to the back side of the under bust band (e.g., defining a right side thereof), where the right side band couples to at least one of the right side sling or the right cup along an edge thereof, and the right side strap couples to the back side of the under bust band via the right side band such that the right side strap connects to the right side band and the right side band connects to the back side of the under bust band.

DETAILED DESCRIPTION

According to various aspects of the present disclosure, an undergarment in the form of a brassiere is provided. In particular, a brassiere is provided that is suitable for wearing while lactating. More particularly, a brassiere is provided that is suitable for wearing while breast feeding. In this regard, the nursing brassiere may also be referred to as a nursing bra. Regardless, several embodiments and variations of features are described herein. It is to be understood that the present invention may be encompassed by any combination of features described more fully herein. Moreover, the specification may from time to time use the term "couple", "couples", "coupled", etc., which should be understood to mean connected or otherwise attached, either directly, or indirectly. Indirect coupling may be achieved via one or more intervening and/or intermediary layers/fabrics/features, etc., some examples of which are set out in greater detail herein.

Figure 1:
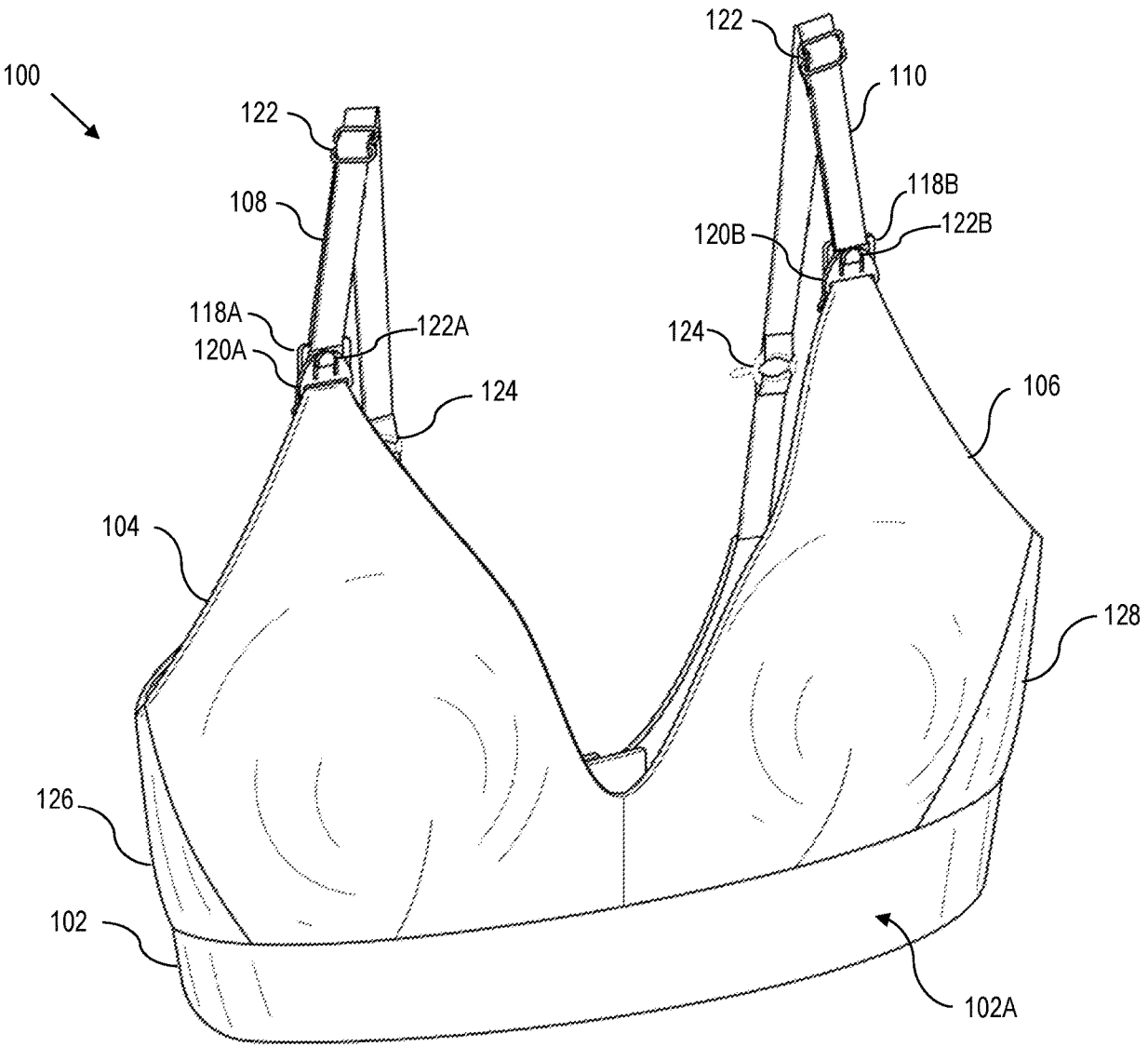
FIG. 1 is a perspective view of a nursing brassiere according to aspects herein.
Figure 2:
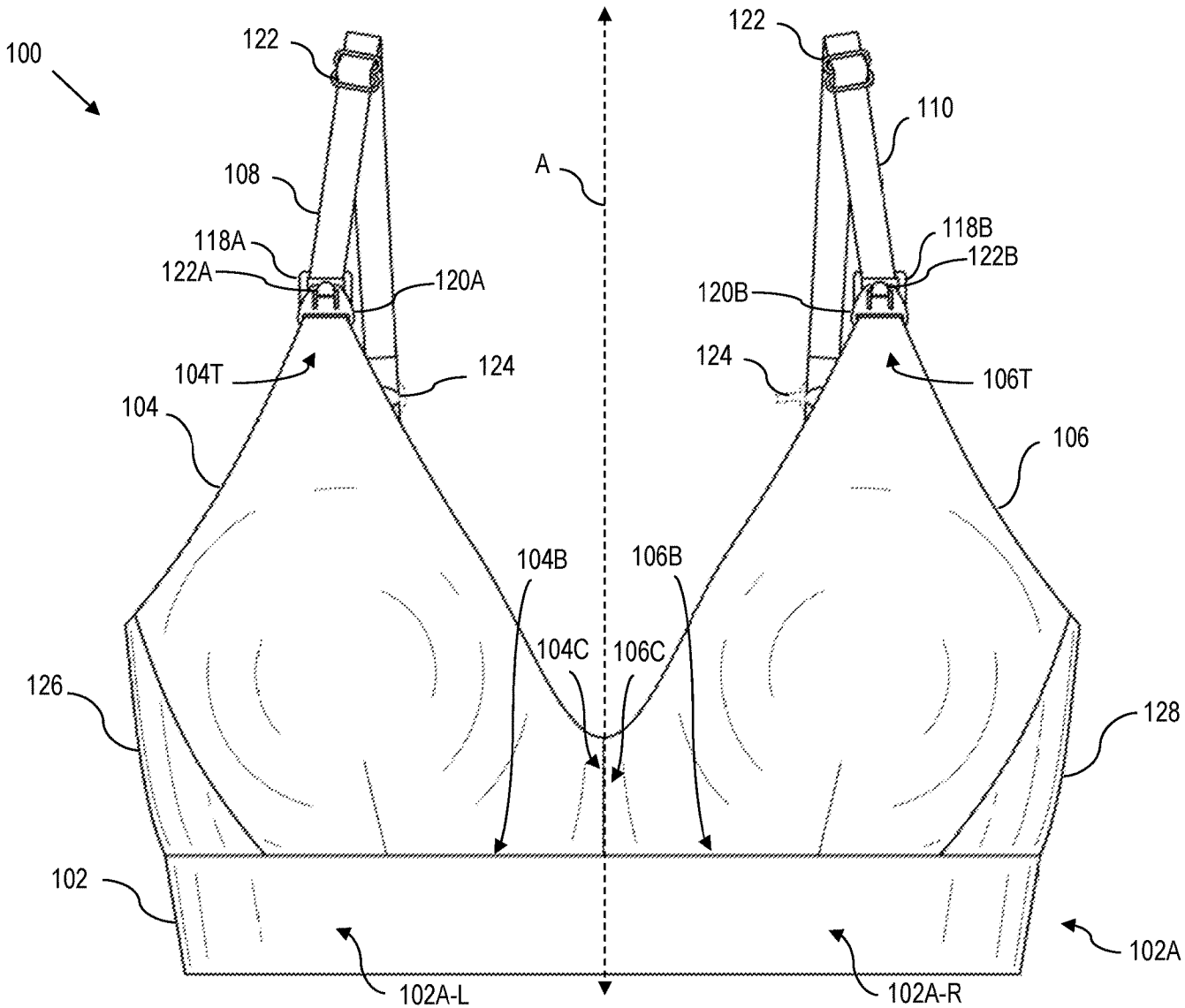
FIG. 2 is a front view of the nursing brassiere of FIG. 1.
Figure 3:
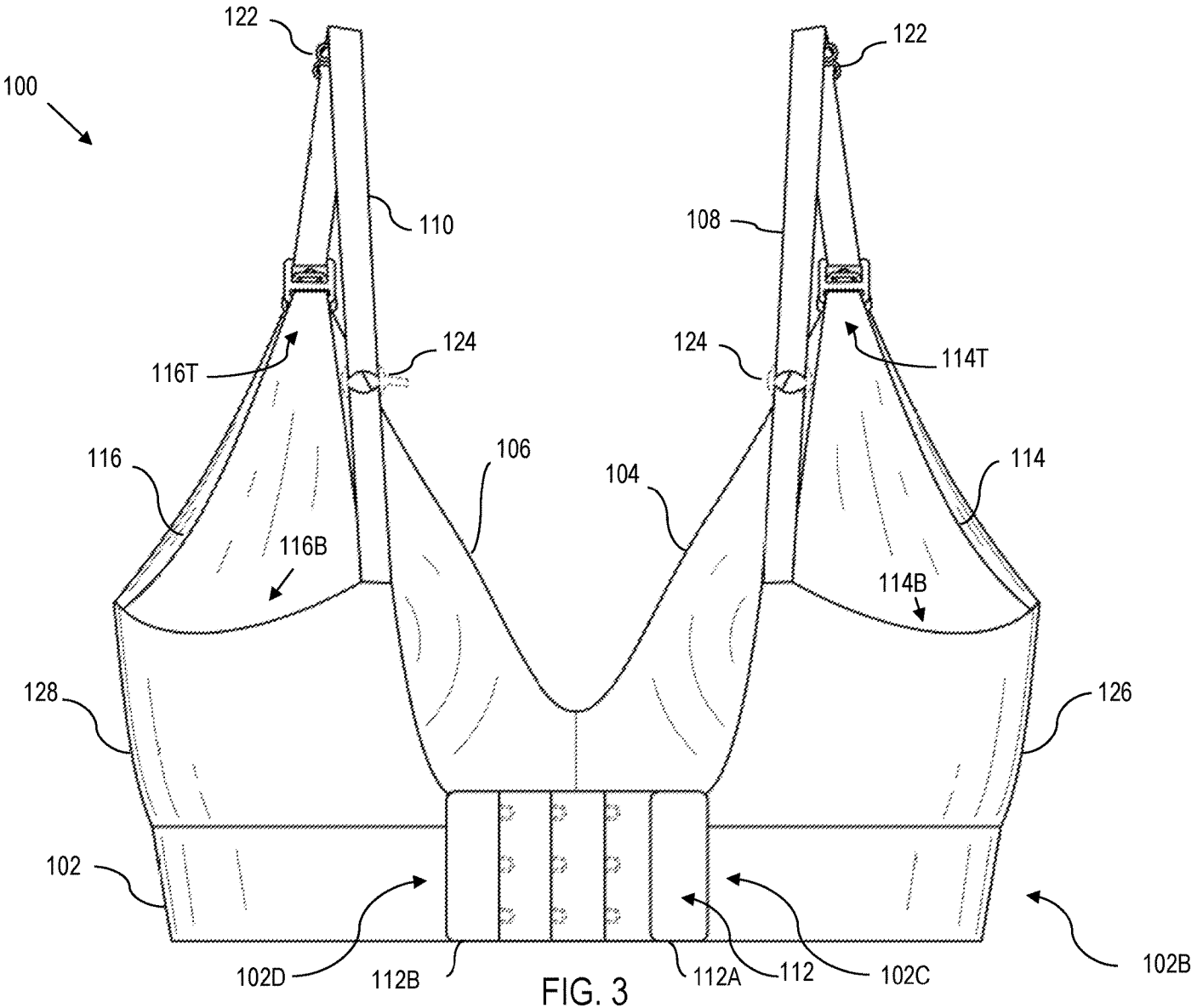
FIG. 3 is a rear view of the nursing brassiere of FIG. 1.
Figure 5:
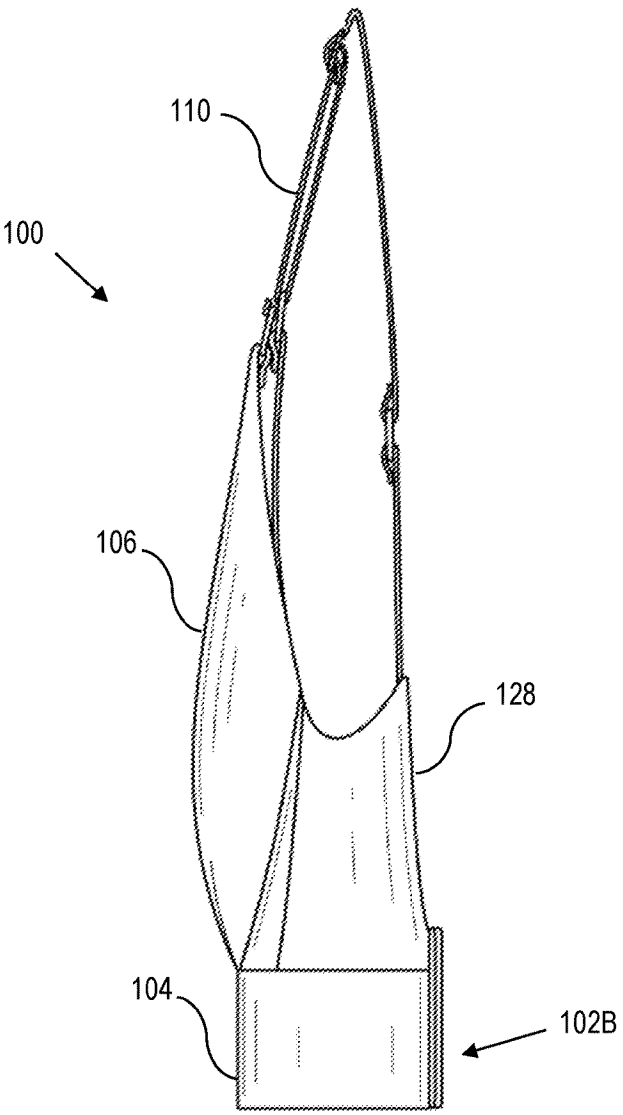
FIG. 5 is a right side view of the nursing brassiere of FIG. 1.
Figure 4:
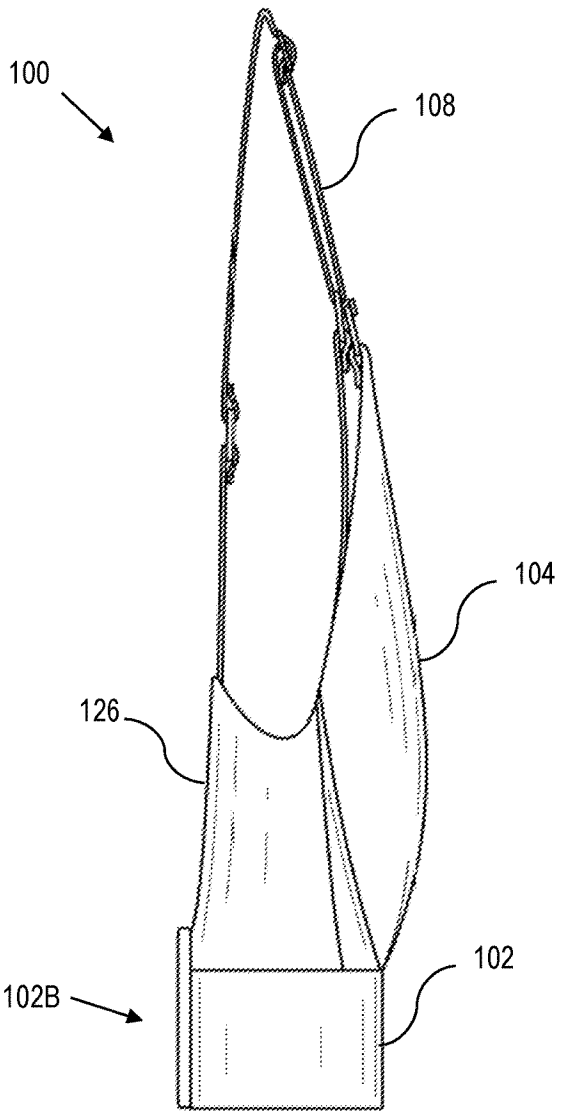
FIG. 4 is a left side view of the nursing brassiere of FIG. 1.
Figure 6:
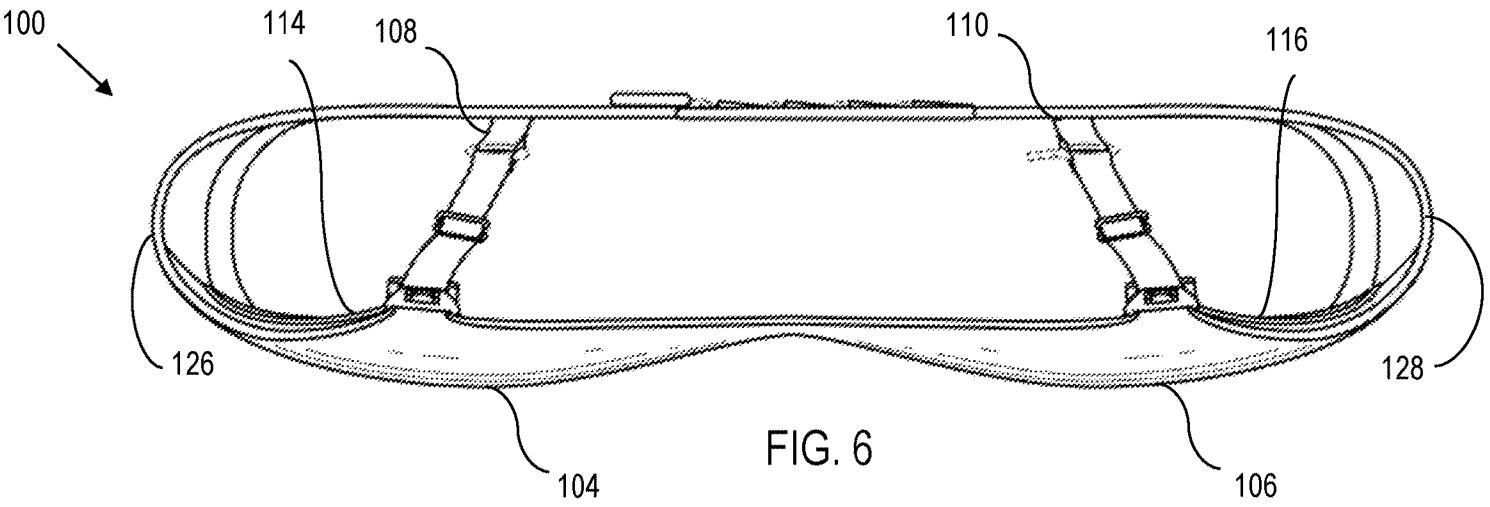
FIG. 6 is a top view of the nursing brassiere of FIG. 1.
Figure 7:
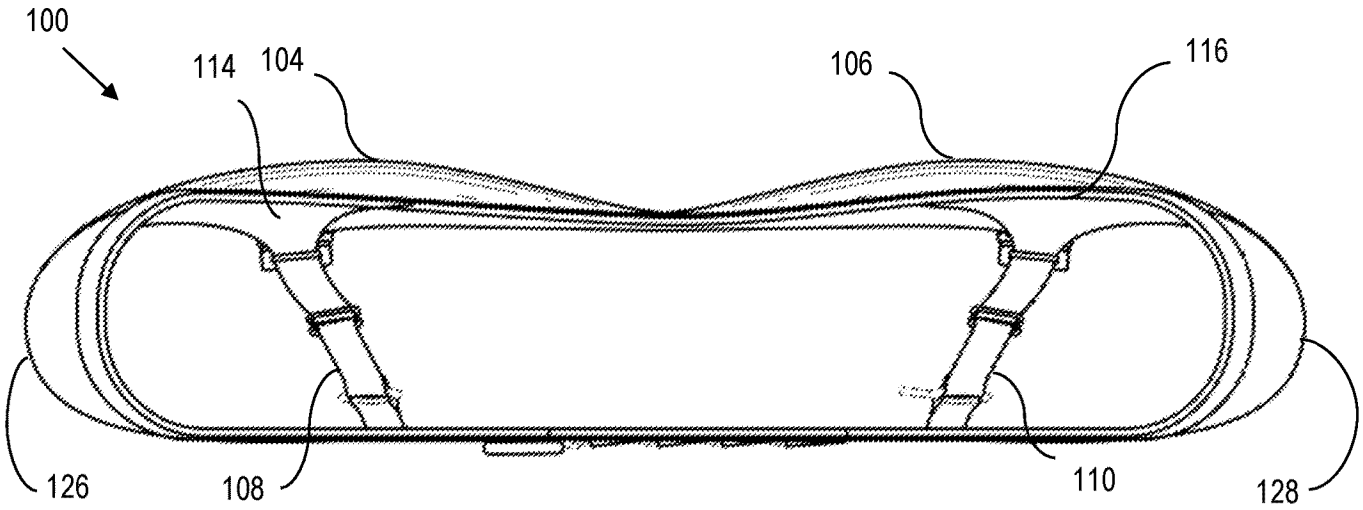
FIG. 7 is a bottom view of the nursing brassiere of FIG. 1.

Referring to the drawings and in particular to FIG. 1, FIG. 2, and FIG. 3, a nursing brassiere 100 is illustrated, according to aspects of the present disclosure. The nursing brassiere 100 includes in general, an under bust band 102, a first cup 104, a second cup 106, a first strap 108, and a second strap 110.

Under Bust Band

The under bust band 102 has a generally elongate shape that wraps around a torso of a wearer thus defining a front side and a back side relative to the torso. For instance, the illustrated under bust band 102 has a generally elongate, rectangular shape defining a front side 102A (see FIG. 1 and FIG. 2), and a back side 102B (see FIG. 3). Here, the front side 102A is positioned against the front side of the torso of the wearer, whereas the back side 102B is positioned against the back torso of the wearer when properly worn. Likewise, with specific regard to FIG. 2, the nursing brassiere 100 can be implemented in a manner that is generally symmetrical relative to an axis A that runs vertically down a centerline of the nursing brassiere 100 as shown. In this regard, the front side 102A of the under bust band 102 can be further delineated into a front-left side 102A-L and a front-right side 102A-R.

In practical implementations, the under bust band 102 can comprise a generally elastic fabric. Although illustrated as a generally elongate rectangular strip of fabric, in practice, the under bust band can take on any desired shape.

In some embodiments, the nursing brassiere 100 can include a connection mechanism that is used to put on and take off the nursing brassiere 100. For instance, as illustrated in FIG. 3, the connection mechanism can be coupled to the under bust band 102 for fastening the brassiere 100 to a wearer. An example connection mechanism is a "hook and eyes" connection mechanism. For instance, in the example configuration shown in FIG. 3, the nursing brassiere 100 includes a hook and eye set 112. The hook and eye set 112 includes a hook member 112A attached to a first end 102C of the under bust band 102. Likewise, the hook and eye set 112 includes a loop (eye) member 112B attached to a second end 102D of the under bust band 102, which is opposite the first end 102C of the under bust band 102.

The hook member 112A includes one or more hooks, e.g., three hooks that are aligned vertically in a column (in FIG. 3, the hooks are concealed by a fabric cover). The illustrated loop member 112B includes multiple horizontally spaced, adjacent sets of vertically stacked loops, e.g., 4 vertical columns of three loops as illustrated. In FIG. 3, three vertical columns of loops are visible, whereas a fourth vertical column of loops is coupled to the hook member 112A. That is, the fourth vertical column of the loop member 112B is concealed by the hook member 112A, and the column of hooks are themselves concealed by the fabric cover covering the hook member 112A. Here, a hook of the hook member hooks to a corresponding loop in a select column of the loop member 112B. By providing multiple columns, adjustability is provided to account for different torso dimensions. This feature can be combined with an elasticity/stretchability of the fabric comprising the under bust band 102 to provide a range of adjustment for comfort while wearing the nursing brassiere 100.

Although shown in the back, the connection mechanism 112 can alternatively be placed in the front, e.g., by moving the first end 102C and the second end 102D of the under bust band 102 to a position between the first cup 104 and the second cup 106.

In yet further embodiments, an "athletic" version may omit a connection mechanism altogether, instead relying upon elastic properties of the under bust band 102. For instance, the first end 102C and second end 102D of the under bust band 102 can be sewn, bonded, or otherwise joined together to form a generally tubular shape.

Cups

Referring specifically to FIG. 2, in the illustrated embodiment, the first cup 104 and the second cup 106 are positioned adjacent to one another. Moreover, each of the first cup 104 and the second cup 106 have a bottom portion that couples to and extends upward from the under bust band 102, e.g., via suitable stitching, bonding, or otherwise joining. For instance, the first cup 104 is to the left of the axis A, thus defining a left cup. The (left) first cup 104 has a bottom portion 104B that couples to the front-left side 102A-L of the under bust band 102. For instance, the bottom portion 104B may be stitched, bonded, or otherwise joined directly to at least a portion of the front-left side 102A-L of the under bust band 102. Likewise, the second cup 106 is to the right of the axis A, thus defining a right cup. The (right) second cup 106 has a bottom portion 106B that couples to the front-right side 102A-R of the under bust band 102. Analogously, the bottom portion 106B may be stitched, bonded, or otherwise joined directly to at least a portion of the front-right side 102A-R of the under bust band 102.

In some embodiments, a portion of the first cup 104 and the second cup 106 are coupled together, e.g., stitched, bonded, or otherwise joined along a common edge thereof.

For instance, the first cup 104 has an edge 104C and the second cup 106 has an edge 106C that can be joined, e.g., sewn together along mating edges 104C, 106C that align along the axis A.

Yet further, in some embodiments, the first cup 104 has a top portion 104T that is generally opposite the bottom portion 104B. Likewise, the second cup has a top portion 106T that is generally opposite the bottom portion 104B.

As will be described in greater detail herein, each of the first cup 104 and the second cup 106 may further comprise an inside cup layer, an absorbent layer, a pad, an outside cup layer, or combinations thereof.

In an example embodiment, the absorbent layer and the pad are stitched in between the inside cup layer and the outside cup layer, e.g., so as to be non-removable, as will be described more fully herein.

Side Sling

Referring specifically to FIG. 3, in some embodiments, the nursing brassiere 100 can include a (left) first side sling 114 and a (right) second side sling 116. In the illustrated embodiment, the first side sling 114 defines a bottom portion 114B and a top portion 114T that is generally opposite the bottom portion 114B. Analogously, the second side sling 116 defines a bottom portion 116B and a top portion 116T that is generally opposite the bottom portion 116B. As illustrated, the top portion approximates a generally triangular shape, although other shapes can be implemented. In this regard, the first side sling 114 (e.g., left side sling) and the second side sling 116 (e.g., right side sling) are generally symmetrical about the axis A (FIG. 2) that runs vertically down the center of the nursing brassiere 100 (and hence down the center of the torso of the wearer). In this regard, the back side of the nursing brassiere 100 as illustrated in FIG. 3 conceals the bottom portion 114B of the first side sling 114 and the bottom portion 116B of the second side sling 116. However, in practical applications, the bottom portion 114B of the first side sling 114 couples to the front-left side 102A-L of the under bust band 102, and the bottom portion 116B of the second side sling 116 couples to the front-right side 102A-R of the under bust band 102.

For instance, the bottom portion 114B may be stitched, bonded, or otherwise joined directly to at least a portion of the front-left side 102A-L of the under bust band 102. Analogously, the bottom portion 116B may be stitched, bonded, or otherwise joined directly to at least a portion of the front-right side 102A-R of the under bust band 102.

Strap

Referring generally to FIG. 1, FIG. 2, FIG. 3, and FIG. 8 the first strap 108 of the nursing brassiere 100 couples to the under bust band 102, e.g., by coupling between the front side 102A of the under bust band 102 and the back side 102B. Analogously, the second strap 110 of the nursing brassiere 100 couples to the under bust band 102, e.g., by coupling between the front side 102A of the under bust band 102 and the back side 102B.

In an example embodiment, the first strap 108 couples to the front side 102A of the under bust band 102 via the first side sling 114. Thus the first strap 108 functions as a left strap. In some embodiments, the first strap 108 is intended to go over the shoulder of a wearer. Thus, the first strap 108 is also referred to herein as a first shoulder strap. In a particular example configuration, the first strap 108 couples to the top 114T of the first side sling 114. The first strap 108 further couples to the under bust band 102 along the back side 102B thereof, as will be described in greater detail herein.

Analogously, in an example embodiment, the second strap 110 couples to the front side 102A of the under bust band 102 via the second side sling 116. Thus the second strap 110 functions as a right strap. In some embodiments, the second strap 110 is intended to go over the shoulder of a wearer. Thus, the second strap 110 is also referred to herein as a second shoulder strap. In a particular example configuration, the second strap 110 couples to the top 116T of the second side sling 116. The second strap 110 further couples to the under bust band 102 along the back side 102B thereof, as will be described in greater detail herein.

Cup/Strap/Side Sling

In an example embodiment, the first strap 108 is connected (e.g., in a manner that is intended to be fixed or non-user detachable) to the top portion 114T of the first side sling 114, and the bottom portion of the first side sling 114 is connected to the under bust band 102. Analogously, the second strap 110 is connected (e.g., in a manner that is intended to be fixed or non-user detachable) to the top portion 116T of the second side sling 116, and the bottom portion of the second side sling 116 is connected to the under bust band 102. As best illustrated in FIG. 1 and FIG. 2, in an example embodiment, the first cup 104 overlies and generally conceals the first side sling 114 from a front view when the top portion 104T of the first cup 104 is connected to at least one of the first strap 108 or the first side sling 114. Likewise, the second cup 106 overlies and generally conceals the second side sling 116 from the front view when the top portion 106T of the second cup 106 is connected to at least one of the second strap 110 or the second side sling 116.

As noted more fully herein, the top portion 104T of the first cup 104 is user connectable and dis-connectable from at least one of the first strap 108 or the first side sling 114. Similarly, the top portion 106T of the second cup 106 is user connectable and dis-connectable from at least one of the second strap 110 or the second side sling 116. Thus, in use, while being worn, the first side sling 114 and the second side sling 116 each provide support to a corresponding breast of the wearer (at least along a side thereof). The first cup 104 and the second cup 106 each cover or otherwise conceal a relatively larger portion of an associated breast. However, when the wearer wishes to breast feed, the user can detach the upper portion (e.g., top portion 104T and/or top portion 106T) of a select cup (e.g., the first cup 104 and/or the second cup 106), fold the cup back along the bottom portion (e.g., bottom portion 104B and/or bottom portion 106B (and expose an area of the breast suitable for breast feeding. When finished, the wearer can re-attach the top portion of the cup and resituate any outerwear as necessary.

Clip

Figure 8:
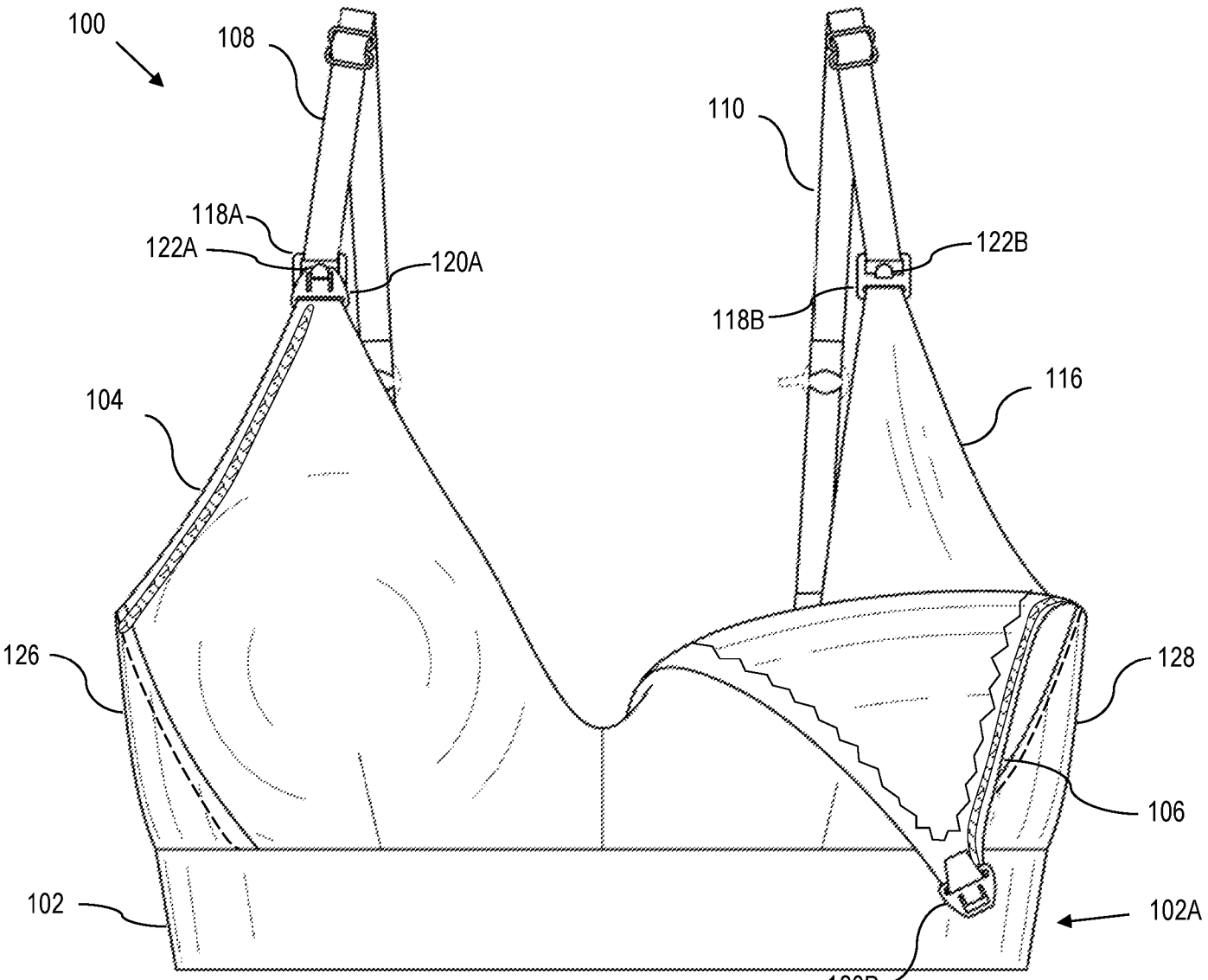
FIG. 8 is a front view of the nursing brassiere of FIG. 1, showing one cup unhooked.

As best illustrated in FIG. 1, FIG. 2, and FIG. 8, in some embodiments, the nursing brassiere 100 can include strap clips 118. In an example embodiment, a first strap clip 118A connects the top portion 114T of the first side sling 114 (see FIG. 3) to the first strap 108. Likewise, a second strap clip 118B connects the top portion 116T of the second side sling 116 (see FIG. 3) to the second strap 110.

Also, in some embodiments, the first cup 104 and the second cup 106 can each include a cup connection member 120. For instance, as illustrated, a first cup connection member 120A is connected to the top portion 104T of the first cup 104. Likewise, a second cup connector 120B is connected to the top portion 106T of the second cup 106. Each cup connection member 120 includes a slot adjacent to a flexible locking panel.

In this configuration, each strap clip 118 further includes a hook 122. For example, the first strap clip 118A includes a first hook 122A. Likewise, the second strap clip 118B includes a second hook 122B.

As an illustrative but non-limiting example, as noted more fully above, the first strap clip 118A couples (e.g., connects/mechanically attaches) the first strap 108 to the first side sling 114, and the first side sling 114 is attached (e.g., stitched) to the under bust band 102 (e.g., along a bottom portion 114B thereof). In this configuration, the hook 122A is oriented outward relative to the wearer. Also, the first cup 104 is coupled to the under bust band 102, e.g., along a bottom portion 104B thereof. To fix the first cup into a "coverage position", the top portion 104T of the first cup 104 is brought up to the first strap clip 118A. The slot in the first cup connection member 120A is inserted into the hook 122A of the first strap clip 118A. The first cup connection member 120A is then rotated downward until the plate snaps under the hook 122A. This temporarily holds the first cup 104 in a coverage position until the wearer decides to open the first cup 104. To transition the first cup 104 to a "feeding position", the wearer rotates or otherwise pivots the first cup connection member 120A upward until the plate releases from the hook bottom, and the slot releases from the hook 122A. This releases the first cup 104 from the first strap clip 118A, allowing the first cup 104 to fold over to an open position. The pliable construction of the first cup 104 provides the necessary flexibility to allow positioning of the first cup 104 out of the way to provide a means to breastfeed. In this regard, the top portion of the first cup 104 is user connectable and dis-connectable from at least one of the first strap 108 or the first side sling 114 (in this case, both by virtue of the coupling of the first strap 108 to the first side sling 114 via the first strap clip 118A).

Analogously, the second strap clip 118B couples (e.g., connects/mechanically attaches) the second strap 110 to the second side sling 116, and the second side sling 116 is attached (e.g., stitched) to the under bust band 102 (e.g., along a bottom portion 116B thereof). In this configuration, the hook 122B is oriented outward relative to the wearer. Also, the second cup 106 is coupled to the under bust band 102, e.g., along a bottom portion 106B thereof. To fix the second cup into a "coverage position", the top portion 106T of the second cup 106 is brought up to the second strap clip 118B. The slot in the second cup connector 120B is inserted into the hook 122B of the second strap clip 118B. The second cup connector 120B is then rotated downward until the plate snaps under the hook 122B. This temporarily holds the second cup 106 in a coverage position until the wearer decides to open the second cup 106. To transition the second cup 106 to a "feeding position", the wearer rotates or otherwise pivots the second cup connector 120B upward until the plate releases from the hook bottom, and the slot releases from the hook 122B. This releases the second cup 106 from the second strap clip 118B, allowing the second cup 106 to fold over to an open position. The pliable construction of the second cup 106 provides the necessary flexibility to allow positioning of the second cup 106 out of the way to provide a means to breastfeed. In this regard, the top portion of the second cup 106 is user connectable and dis-connectable from at least one of the second strap 110 or the second side sling 116 (in this case, both by virtue of the coupling of the second strap 110 to the second side sling 116 via the second strap clip 118B).

Optional Features

Referring to FIG. 1, FIG. 2, and FIG. 3, the nursing brassiere 100 can include other optional features, such as optional shoulder adjustment bands 122, an optional racer back hook set 124, etc. The shoulder strap bands 122 allow adjustment of the first strap 108 and/or the second strap 110 so as to fit comfortably over the shoulders of the wearer. The racer back hook set 124 pulls a back portion of the first strap 108 and the second strap 110 together towards the center of the back of the wearer so that the first strap 108 and/or the second strap 110 do not show through certain outerwear garments, e.g., sleeveless shirts, etc.

Side Band

In some embodiments, the nursing brassiere 100 includes side bands. For instance, FIG. 3, FIG. 4, FIG. 6, and FIG. 7 illustrate a first side band 126 that is coupled to and extends from the under bust band 102, e.g., from the front side 102A of the under bust band 102 to the back side 102B of the under bust band 102. More specifically, the first side band 126 couples to at least one of the first side sling 114 or the first cup 104 along an edge thereof. In a practical application, stitching is used to connect an edge of the first side band 126 to both the first cup 104 and the first side sling 114 along a common seam. The first side band 126 basically wraps around the left side of the wearer and is seamed along an edge of the under bust band 102. In this regard, the first strap 108 couples to the back side 102B of the under bust band 102 via the first side band 126 such that the first strap 108 connects to the first side band 126 and the first side band 126 connects to the back side 102B of the under bust band 102.

Analogously, FIG. 3, FIG. 5, FIG. 6, and FIG. 7 illustrate a second side band 128 that is coupled to and extends from the under bust band 102, e.g., from the front side 102A of the under bust band 102 to the back side 102B of the under bust band 102. More specifically, the second side band 128 couples to at least one of the second side sling 116 or the second cup 106 along an edge thereof. In a practical application, stitching is used to connect an edge of the second side band 128 to both the second cup 106 and the second side sling 116 along a common seam. The second side band 128 basically wraps around the right side of the wearer and is seamed along an edge of the under bust band 102. In this regard, the second strap 110 couples to the back side 102B of the under bust band 102 via the second side band 128 such that the second strap 110 connects to the second side band 128 and the second side band 128 connects to the back side 102B of the under bust band 102.

Referring generally to FIG. 2, FIG. 3, FIG. 4, and FIG. 5, in an example embodiment, the first cup 104 and the first side sling 114 are stitched to the under bust band 102 along a first common edge segment, the first cup 104 and the first side sling 114 are stitched to the first side band 126 along a second common edge segment, and the first cup 104 generally overlies the first side sling 114 (e.g., the first side sling 114 is not visible in FIG. 2). Correspondingly, the second cup 106 and the second side sling 116 are stitched to the under bust band 102 along a third common edge segment, the second cup 106 and the second side sling 116 are stitched to the second side band 128 along a fourth common edge segment, and the second cup 106 generally overlies the second side sling 116 (e.g., the second side sling 116 is not visible in FIG. 2).

General Observations

In practical applications, any inside and/or skin contacting layers may comprise a comfort layer, e.g., a cotton modal and spandex blend. In some embodiments, the ratio of cotton modal to spandex is such to be "breathable" but not necessarily wicking. In this regard, wicking may be an undesirable feature as wicking may distribute liquids to areas, e.g., edges of the nursing brassiere 100, which can lead to discomfort, and potentially, leaking. Thus, in some embodiments, at least the inside layer of the first cup 104 and the second cup 106 allow moisture to pass through to the absorbent layer without wicking in a way that would otherwise lead to leaking or discomfort to the wearer (e.g., via using cotton modal and spandex blend that is absorbent).

In yet further example embodiments, the straps couple to the under bust band 102 in both the front side 102A and the back side 102B. By way of example, the straps can couple directly to the under bust band 102, or the straps can couple via intermediate layers, such as a side sling, side bands, etc., as noted more fully herein.

Example Cup Construction

Figure 9:
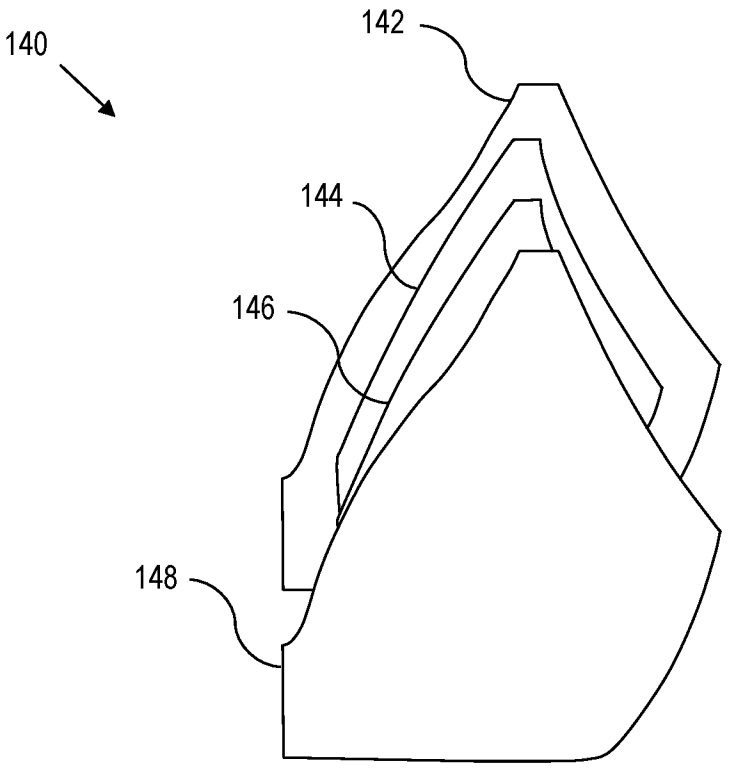
FIG. 9 is an assembly drawing of a cup assembly for a nursing brassiere according to aspects of the present disclosure.

Referring to FIG. 9, as noted more fully herein, each cup (e.g., first cup 104 and second cup 106; FIG. 1) includes an inside cup layer, an absorbent layer, a pad, and an outside cup layer, or combinations thereof.

For instance, as illustrated, a cup assembly 140 includes an inside cup layer 142, an absorbent layer 144, a pad 146, and an outside cup layer 148. The cup assembly 140 can be utilized to implement the first cup 104 and the second cup 106.

In an example embodiment, the inside cup layer 142 and the outside cup layer 148 comprise a comfortable fabric, e.g., a cotton modal and spandex blend.

In an example embodiment, the absorbent layer 144 and the pad 146 are stitched together to form an intermediate component, such as a stitched inner assembly.

Further, the stitched inner assembly may be stitched to the inside cup layer 142 but not to the outside cup layer 148. Thus, the stitched inner assembly is stitched to the inside cup layer 142 such that any stitching is only visible from the inside of the brassiere. This eliminates stitch lines on the outer surface of the cup assembly 140, thus providing a smoother, appearance that might otherwise be visible and unsightly when combined with certain outerwear. In this regard, looking at the cup assembly 140 as a "stack", the absorbent layer 144 may be stitched to the pad 146 to define a stitched inner assembly. The stitched inner assembly may be stitched to the inside cup layer 142, and the inside cup layer 142 may be stitched to the outside cup layer 148 around a periphery thereof, thus concealing the stitched inner assembly between the inside cup layer 142 and the outside cup layer 148.

Thus, in some embodiments, the layers are arranged such that the absorbent layer is positioned between the pad and the inside cup layer, and the pad is positioned between the absorbent layer and the outside cup layer.

Also, in some embodiments, the absorbent layer 144 and the pad 146 may be assembled in between the inside cup layer 142 and the outside cup layer 148 so as to be non-removable. For instance, the inside cup layer 142 may be stitched to the outside cup layer 148 around an entirety of the periphery thereof.

Currently, moms wear removable (typically foam) pads within their bras. However, the removable pads are cumbersome and ineffective. For instance, the pads are difficult to re-insert, and do not keep a flattering shape. Moreover, the pads can shift causing discomfort and inconsistent performance. By comparison, the absorbent layer 144 and the pad 146 in some embodiments, are assembled in between the inside cup layer 142 and the outside cup layer 148 so as to be non-removable. In some embodiments, the absorbent layer 144 and the pad 146 are stitched to the inside cup layer 142, thus defining a fixed position that will not change relative to the inside cup layer 142.

The breathable nature of the inside cup layer 142 and/or outside cup layer 148 allow effective washing, and the absorbent layer 144 and the pad 146 maintain their position within the cup (e.g., via stitching), thus providing consistent performance across wear/wash cycles.

In some embodiments, the absorbent layer 144 comprises a leakproof layer. For instance, lactating moms may leak breastmilk, even when they are not nursing their baby. This can cause bothersome wetness and stains, even on their outerwear clothes. Here, the leakproof layer prevents such stains that can appear through clothing, including outerwear. By way of example, the leakproof layer may comprise a waterproof coating.

In some embodiments, the leakproof layer of the absorbent layer 144 is positioned adjacent to the pad 146.

In some embodiments, the absorbent layer 144 and the pad 146 are each cut as a flat, pliable shape so as to not be cup shaped. When combined as a "non-removable" feature, this enables the nursing brassiere 100 to retain a natural and comfortable shape. In some embodiments, the absorbent layer 144 and the pad 146 form an assembly that is pliable and conformal that does not have a normally defined three-dimensional shape. This allows the cup to conform to a comfortable position. This solves a significant problem with conventional nursing bras. Typically, the nursing bra includes a pad that is removable. The pad is also typically cup shaped. Once removed, or even once washed, it is likely that the pad becomes dislodged from its intended position making the nursing bra uncomfortable, unsightly, and time consuming to reconfigure.

Yet further, traditional pads shapes, e.g., traditional foam three-dimensional cup shapes, often get in the way of a baby's face when pulled down, obstructing the ability to nurse with ease. However, the present nursing brassiere 100 includes a side sling design that allows for more skin-to-skin contact with the baby while breastfeeding. Additionally, the flat, pliable shape of the absorbent layer 144 and the pad 146 allow reliable repositioning of the folded cup away from the baby's face.

In example embodiments, the absorbent layer 144 may comprise a thermoplastic polyurethane membrane that is bonded to a base fabric. As another example, the pad 146 may comprise a cotton absorbing blend fabric, e.g., sherpa fabric.

Yet further, in some embodiments, a nursing brassiere is assembled such that the absorbent layer 144 and the pad 146 are each absorbent, and the inside cup layer 142 and the outside cup layer 148 comprise a breathable fabric, e.g., a cotton, modal, spandex blend. For instance, in some embodiments, the blend is about 57% cotton, 38% modal, and 5% spandex.

Thus, the inside cup layer may comprise a blend of spandex with a modal fabric. Likewise, the outside cup layer may comprise a blend of spandex with a modal fabric. In some embodiments, the inside cup layer may be breathable but not wicking.

Given the above combination of features, the nursing brassiere 100 according to aspects herein, may be, for instance, 1.5 times more absorbent than traditional nursing brassieres. Moreover, the present nursing brassiere 100 exhibits a greater ability to prevent leakage (e.g., an embodiment may be six times more effective at preventing leaks compared to traditional nursing brassieres). In some example embodiments, the nursing brassiere herein can absorb, for instance, about 2.4 times its weight in milk, whereas the pads themselves can absorb about 3.9 times their weight in milk. Additionally, in some embodiments, each pad may have the ability to contain up to, and exceeding 1 fluid ounce or more. In an example configuration, pads were noted as having the ability to contain 1.14 fluid ounces.

ADDITIONAL EXAMPLES

An example nursing brassiere may thus comprise an under bust band having a generally elongate shape that wraps around a torso of a wearer thus defining a front side and a back side relative to the torso.

A left side sling has a bottom portion and a top portion generally opposite the bottom portion, where the bottom portion couples to the under bust band along at least a portion of the front side thereof.

A right side sling has a bottom portion and a top portion generally opposite the bottom portion, where the bottom portion couples to the under bust band along at least a portion of the front side thereof.

A left side strap couples the top portion of the left side sling to the under bust band along the back side thereof.

Likewise, a right side strap couples the top portion of the right side sling to the under bust band along the back side thereof.

A left side cup has an inside cup layer, an absorbent layer, a pad, and an outside cup layer, where the left side cup further defines a bottom portion and a top portion generally opposite the bottom portion, the absorbent layer and the pad are stitched in between the inside cup layer and the outside cup layer so as to be non-removable, the bottom portion of the left side cup is coupled to the under bust band along at least a portion of the front side thereof, and the top portion of the left side cup is user connectable and dis-connectable from at least one of the left side strap or the left side sling.

Analogously, a right side cup has an inside cup layer, an absorbent layer, a pad, and an outside cup layer, where the right side cup further defines a bottom portion and a top portion generally opposite the bottom portion, the absorbent layer and the pad are stitched in between the inside cup layer and the outside cup layer so as to be non-removable, the bottom portion of the right side cup is coupled to the under bust band along at least a portion of the front side thereof, and the top portion of the right side cup is user connectable and dis-connectable from at least one of the right side strap or the right side sling.

A left side band is coupled to and extends from the front side of the under bust band to the back side of the under bust band, where the left side band couples to at least one of the left side sling or the left cup along an edge thereof. The left side strap couples to the back side of the under bust band via the left side band such that the left side strap connects to the left side band and the left side band connects to the back side of the under bust band.

Similarly, a right side band is coupled to and extends from the front side of the under bust band to the back side of the under bust band, where the right side band couples to at least one of the right side sling or the right cup along an edge thereof. The right side strap couples to the back side of the under bust band via the right side band such that the right side strap connects to the right side band and the right side band connects to the back side of the under bust band.

In some embodiments, the left cup and the left side sling are stitched to the under bust band along a first common edge segment. The left cup and the left side sling are stitched to the left side band along a second common edge segment.

Analogously, the right cup and the right side sling are stitched to the under bust band along a third common edge segment. The right cup and the right side sling are stitched to the right side band along a fourth common edge segment.

Moreover, in some embodiments, the left cup is stitched to the right cup along a fifth common edge segment. Yet further, in some embodiments, the left cup overlies the left side sling, and the right cup overlies the right side sling.

Also, in some embodiments, the nursing brassiere further comprises a left clip that connects the left strap to the top portion of the left side sling. In this configuration, the top portion of the left cup is user attachable and user detachable from the clip. Analogously, a right clip connects the right strap to the top portion of the right side sling. Moreover, the top portion of the right cup is user attachable and user detachable from the right clip.

In another example configuration, a nursing brassiere has an under bust band having a generally elongate shape that wraps around a torso of a wearer thus defining a front side and a back side relative to the torso.

A first cup and a second cup are positioned adjacent to one another. Each of the first cup and the second cup have a bottom portion that couples to and extends upward from the under bust band. Each of the first cup and the second cup further comprise an inside cup layer, an absorbent layer, a pad, and an outside cup layer.

Under this configuration, the absorbent layer and the pad are stitched in between the inside cup layer and the outside cup layer so as to be non-removable.

A first shoulder strap is coupled to the under bust band, where the first cup is user connectable and user dis-connectable from the first shoulder strap. Likewise, a second shoulder strap is coupled to the under bust band, where the second cup is user connectable and user dis-connectable from the second shoulder strap.

In some embodiments, each absorbent layer is positioned between the corresponding pad and the corresponding inside cup layer, where each pad is positioned between the corresponding absorbent layer and the corresponding outside cup layer. In some embodiments, each absorbent layer comprises a leakproof layer having a waterproof coating that is positioned adjacent to the pad. Also, in some embodiments, each corresponding absorbent layer and pad are cut as a flat, pliable shape so as to not be cup shaped, are stitched together to define a stitched inner assembly, and the stitched inner assembly is stitched to the inside cup layer but not to the outside cup layer such that any stitching is only visible from the inside of the brassiere.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the invention in the form disclosed. Many modifications and variations will be apparent to those of ordinary skill in the art without departing from the scope and spirit of the invention. Aspects of the disclosure were chosen and described in order to best explain the principles of the invention and the practical application, and to enable others of ordinary skill in the art to understand the invention for various embodiments with various modifications as are suited to the particular use contemplated.

What is claimed is:

1. A nursing brassiere having:

an under bust band having a generally elongate shape that that is configured to wrap around a torso of a wearer thus defining a front side and a back side relative to the torso when the nursing brassiere worn;

a side sling having a bottom portion and a top portion generally opposite the bottom portion, wherein the bottom portion couples to the under bust band along at least a portion of the front side thereof;

a strap that couples to the top portion of the side sling, wherein the strap further couples to the under bust band along the back side thereof; and a cup having an inside cup layer, an absorbent layer, a pad, and an outside cup layer, wherein:

the cup further defines a bottom portion and a top portion generally opposite the bottom portion;

the absorbent layer and the pad are stitched in between the inside cup layer and the outside cup layer so as to be non-removable;

the bottom portion of the cup is coupled to the under bust band along at least a portion of the front side thereof; and the top portion of the cup is configured to connect and dis-connect from at least one of the strap or the side sling.

2. The nursing brassiere of claim 1 further comprising:

a side band, wherein:

the side band is coupled to and extends from the under bust band from the front side of the under bust band to the back side of the under bust band;

the side band couples to at least one of the side sling or the cup along an edge thereof; and the strap couples to the back side of the under bust band via the side band such that the strap connects to the side band and the side band connects to the back side of the under bust band.

3. The nursing brassiere of claim 2, wherein:

the cup and the side sling are stitched to the under bust band along a first common edge segment;

the cup and the side sling are stitched to the side band along a second common edge segment; and the cup overlies the side sling.

4. The nursing brassiere of claim 1 further comprising:

a clip that connects the strap to the top portion of the side sling, wherein the top portion of the cup is configured to attach and detach from the clip.

5. The nursing brassiere of claim 1, wherein:

the absorbent layer comprises a leakproof layer having a waterproof coating.

6. The nursing brassiere of claim 5, wherein:

the leakproof layer of the absorbent layer is positioned adjacent to the pad.

7. The nursing brassiere of claim 1, wherein:

the absorbent layer and the pad are stitched together to define a stitched inner assembly; and the stitched inner assembly is stitched to the inside cup layer but not to the outside cup layer such that the stitched is only visible from the inside of the brassiere.

8. The nursing brassiere of claim 1, wherein:

the absorbent layer is positioned between the pad and the inside cup layer; and the pad is positioned between the absorbent layer and the outside cup layer.

9. The nursing brassiere of claim 1, wherein:

the absorbent layer and the pad are each cut as a flat, pliable shape so as to not be cup shaped.

10. The nursing brassiere of claim 1, wherein:

the absorbent layer and the pad are each absorbent, and the inside cup layer and the outside cup layer comprise a breathable fabric.

11. The nursing brassiere of claim 1, wherein:

the inside cup layer is a breathable cotton modal and spandex blend.

12. The nursing brassiere of claim 1, wherein:

the pad comprises a cotton absorbing blend fabric.

13. The nursing brassiere of claim 1, wherein:

the absorbent layer comprises a thermoplastic polyurethane membrane that is bonded to a base fabric.

14. The nursing brassiere of claim 1, wherein:

the inside cup layer comprises a blend of spandex with a modal fabric; and the outside cup layer comprises a blend of spandex with a modal fabric.

15. The nursing brassiere of claim 1 further comprising:

a connection mechanism coupled to the under bust band that is configured to fasten the brassiere to the wearer.

16. A nursing brassiere having:

an under bust band having a generally elongate shape that is configured to wrap around a torso of a wearer thus defining a front side and a back side relative to the torso when the nursing brassiere worn;

a first cup and a second cup positioned adjacent to one another, each of the first cup and the second cup having a bottom portion that couples to and extends upward from the under bust band, each of the first cup and the second cup further comprising:

an inside cup layer;

an absorbent layer;

a pad; and an outside cup layer;

wherein:

the absorbent layer and the pad are stitched in between the inside cup layer and the outside cup layer so as to be non-removable;

a first shoulder strap coupled to the under bust band, wherein the first cup is configured to connect and dis-connect from the second shoulder strap; and a second shoulder strap coupled to the under bust band, wherein the second cup is configured to connect and dis-connect from the second shoulder strap.

17. The nursing brassiere of claim 16, wherein:

each absorbent layer is positioned between the corresponding pad and the corresponding inside cup layer;

each pad is positioned between the corresponding absorbent layer and the corresponding outside cup layer;

each absorbent layer comprises a leakproof layer having a waterproof coating that is positioned adjacent to the pad;

each corresponding absorbent layer and pad are cut as a flat, pliable shape so as to not be cup shaped, and are stitched together to define a stitched inner assembly; and the stitched inner assembly is stitched to the inside cup layer but not to the outside cup layer such that said stitched is only visible from the inside of the brassiere.

18. A nursing brassiere having:

an under bust band having a generally elongate shape that is configured to wrap around a torso of a wearer thus defining a front side and a back side relative to the torso when the nursing brassiere worn;

a left side sling having a bottom portion and a top portion generally opposite the bottom portion, wherein the bottom portion couples to the under bust band along at least a portion of the front side thereof;

a right side sling having a bottom portion and a top portion generally opposite the bottom portion, wherein the bottom portion couples to the under bust band along at least a portion of the front side thereof;

a left side strap that couples the top portion of the left side sling to the under bust band along the back side thereof;

a right side strap that couples the top portion of the right side sling to the under bust band along the back side thereof;

a left side cup having an inside cup layer, an absorbent layer, a pad, and an outside cup layer, wherein the left side cup further defines a bottom portion and a top portion generally opposite the bottom portion, the absorbent layer and the pad are stitched in between the inside cup layer and the outside cup layer so as to be non-removable, the bottom portion of the left side cup is coupled to the under bust band along at least a portion of the front side thereof, and the top portion of the left side cup is configured to connect and disconnect from at least one of the left side strap or the left side sling;

a right side cup having an inside cup layer, an absorbent layer, a pad, and an outside cup layer, wherein the right side cup further defines a bottom portion and a top portion generally opposite the bottom portion, the absorbent layer and the pad are stitched in between the inside cup layer and the outside cup layer so as to be non-removable, the bottom portion of the right side cup is coupled to the under bust band along at least a portion of the front side thereof, and the top portion of the right side cup is configured to connect and disconnect from at least one of the right side strap or the right side sling;

a left side band that is coupled to and extends from the front side of the under bust band to the back side of the under bust band, wherein the left side band couples to at least one of the left side sling or the left cup along an edge thereof, and the left side strap couples to the back side of the under bust band via the left side band such that the left side strap connects to the left side band and the left side band connects to the back side of the under bust band; and a right side band that is coupled to and extends from the front side of the under bust band to the back side of the under bust band, where the right side band couples to at least one of the right side sling or the right cup along an edge thereof, and the right side strap couples to the back side of the under bust band via the right side band such that the right side strap connects to the right side band and the right side band connects to the back side of the under bust band.

19. The nursing brassiere of claim 18, wherein:

the left cup and the left side sling are stitched to the under bust band along a first common edge segment;

the left cup and the left side sling are stitched to the left side band along a second common edge segment;

the left cup overlies the left side sling;

the right cup and the right side sling are stitched to the under bust band along a third common edge segment;

the right cup and the right side sling are stitched to the right side band along a fourth common edge segment;

the left cup is stitched to the right cup along a fifth common edge segment;

the left cup overlies the left side sling; and the right cup overlies the right side sling.

20. The nursing brassiere of claim 18 further comprising:

a left clip that connects the left strap to the top portion of the left side sling, wherein the top portion of the left cup is configured to be user attachable and user detachable from the clip; and a right clip that connects the right strap to the top portion of the right side sling, wherein the top portion of the right cup is configured to be user attachable and user detachable from the right clip.

* * * * *